United States Patent [19]

Zulauf et al.

[11] Patent Number: 4,865,187

[45] Date of Patent: Sep. 12, 1989

[54] BLOCK-SHAPED DISPLAY CARTON

[75] Inventors: Wolfgang Zulauf; Bernhard Huflage, both of Minden, Fed. Rep. of Germany

[73] Assignee: Melitta-Werke Bentz & Sohn, Minden, Fed. Rep. of Germany

[21] Appl. No.: 206,388

[22] Filed: Jun. 14, 1988

[30] Foreign Application Priority Data

Jun. 15, 1987 [DE] Fed. Rep. of Germany ..... 8708423

[51] Int. Cl.[4] ..... B65D 25/00

[52] U.S. Cl. ..... 206/45.31; 206/44.12; 206/606; 206/614; 206/628; 206/634

[58] Field of Search ..... 206/44.11, 44.12, 45.31, 206/606, 614, 615, 626, 627, 628, 634

[56] References Cited

U.S. PATENT DOCUMENTS

| | | | |
|---|---|---|---|
| 2,888,132 | 5/1959 | Guyer | 206/627 |
| 3,224,633 | 12/1965 | Allen | 206/606 |
| 3,315,875 | 4/1967 | Praetorius | 206/44.12 |
| 3,411,697 | 11/1968 | Hightower et al. | 206/628 |
| 3,872,966 | 3/1975 | Gordon et al. | 206/45.31 |
| 4,405,044 | 9/1983 | Flower et al. | 206/45.31 |
| 4,570,796 | 2/1986 | Groom | 206/628 |
| 4,621,736 | 11/1986 | Roccaforte | 206/606 |

*Primary Examiner*—David T. Fidei
*Attorney, Agent, or Firm*—Spencer & Frank

[57] ABSTRACT

A display carton for merchandise in individual packages has a tear strip adjacent the cover of the carton. The carton includes a front wall with a removal opening which extends up to the tear strip, and a side wall with a removable panel can easily be removed from the carton, exposing the packaged merchandised so that the price can be marked. The marked merchandise can then be placed on a shelf for sale without removing it from the carton.

7 Claims, 2 Drawing Sheets

BLOCK-SHAPED DISPLAY CARTON

BACKGROUND OF THE INVENTION

The present invention relates to a block-shaped display carton for individually packaged merchandise.

Many individually packaged goods are presently combined into large sales units and marketed in block-shaped display cartons.

Particularly in self-service stores, the individually packaged merchandise is not taken out of the display carton. Instead, the display carton is opened, the merchandise is marked with the price, and customers then take the merchandise directly from the display carton. When the display carton is completely empty, it is removed from the shelf and replaced by a new, full one.

SUMMARY OF THE INVENTION

It is the object of the present invention to provide a display carton of the above-mentioned type which can be opened extremely quickly and easily, and which after opening permits marking of the merchandise and easy removal of the merchandise.

This object is attained, according to the invention, by providing a display carton having a cover which is connected with the walls of the display carton by a peripheral tear strip. One side wall is provided with perforation lines, at a distance from the bottom and at a distance from the front and rear walls, to permit tearing away the major portion of the side wall. The front wall is provided with a removal opening which extends from the tear strip to the vicinity of the bottom.

Such a display carton is extremely suitable for use in practice, particularly in self-service stores, since the tear strip and the perforation lines permit quick and trouble-free opening of the display carton. Furthermore, the removal of a large-area side wall permits marking of the merchandise without having to first take it out of the display carton.

Every customer is able to remove the merchandise he desires easily even if several display cartons are placed in close proximity of one another.

DESCRIPTION OF THE PREFERRED EMBODIMENTS

Figure 1:
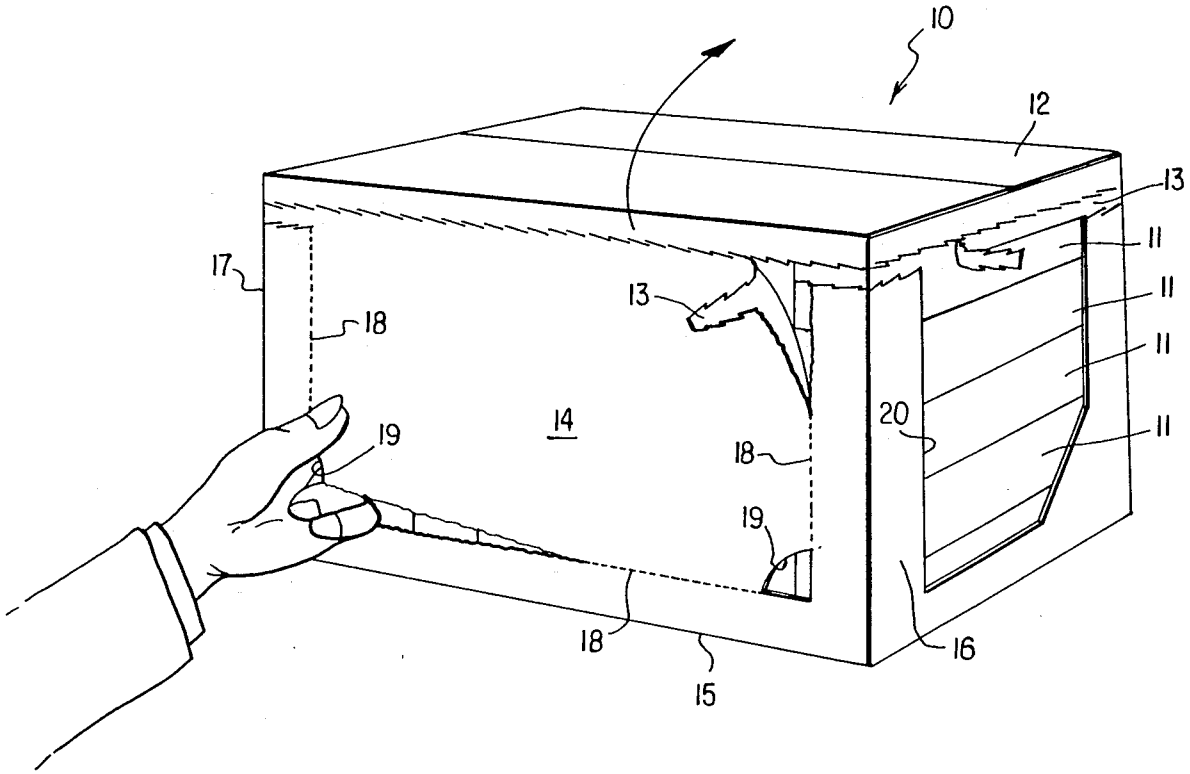
FIG. 1 is a perspective view of a display carton according to the present invention.

The display carton shown in FIG. 1, and marked as a whole with the reference numeral 10, has a block shape and accommodates a plurality of individually wrapped goods.

As examples of such individually wrapped merchandise, reference is made here in an exemplary manner to freezer bags, aluminum foil, household wraps or the like.

Such merchandise is of course offered for sale in separate packages 11.

As shown in FIG. 1, the entire cover 12 of display carton 10 is connected with the remaining walls of the display carton by means of a peripheral tear strip 13.

This peripheral tear strip 13 (sometimes known in the art as a body tear strip) permits trouble-free removal of the complete cover 12 and thus opening of display carton 10 toward its upper side.

One side wall 14 of display carton 10 is provided with perforation lines !8 at a distance from bottom 15 and at a distance from front wall 16 and rear wall 17, respectively. The perforation lines 18 extend in the direction of cover 12 up to tear strip 13.

In the embodiment of FIG. 1, finger openings 19 are provided in the lower corner region of perforation lines 18 so as to permit tearing away of the major portion of said side wall 14.

Front wall 16 is provided with a removal opening 20 which extends from tear strip 13 to the vicinity of bottom 15.

After removal of cover 12 and after removal of the major portion of side wall 14, the packages 11 can be marked without trouble from the region of the open side wall 14 without the individual packages 11 having to be removed from display carton 10. Thus, the work to be performed by the personnel of a self-service store is limited to a minimum and can be performed quickly and easily.

Figure 2:
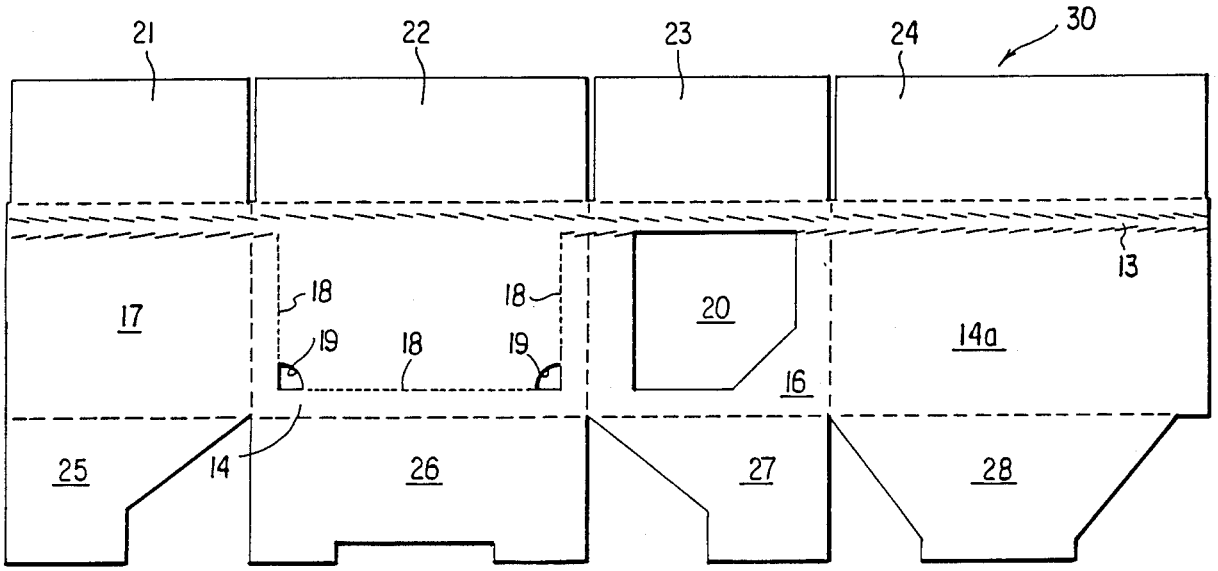
FIG. 2 is a top view of a flat cut-out blank for making the display carton of FIG. 1.

FIG. 2 shows a flat cut-out blank 30 for the display carton 10. In FIG. 2 the dashed lines indicate fold lines and the dotted lines on side wall 14 indicate lines of perforations.

It can clearly be seen that flaps 21, 22, 23, and 24, which form cover 12 when display carton 10 is stood up, are connected with the two side walls 14 and 14*a* and with front wall 16 and rear wall 17 via the tear strip 13, so that the entire cover can be quickly separated from the remaining portion of display carton 10 when the display carton is stood up.

The side wall 14, disposed between front wall 16 and rear wall 17, is provided with perforation lines 18 which extend to tear strip 13. Finger openings 19 are provided at the bottom corner regions of perforation lines 18 to permit easy removal of the major portion of side wall 14. Front wall 16 is provided with a removal opening 20 which extends from tear strip 13 to the vicinity of the bottom.

The bottom 15 (see FIG. 1) of the display carton is formed by flaps 25, 26, 27, and 28.

Figure 3:
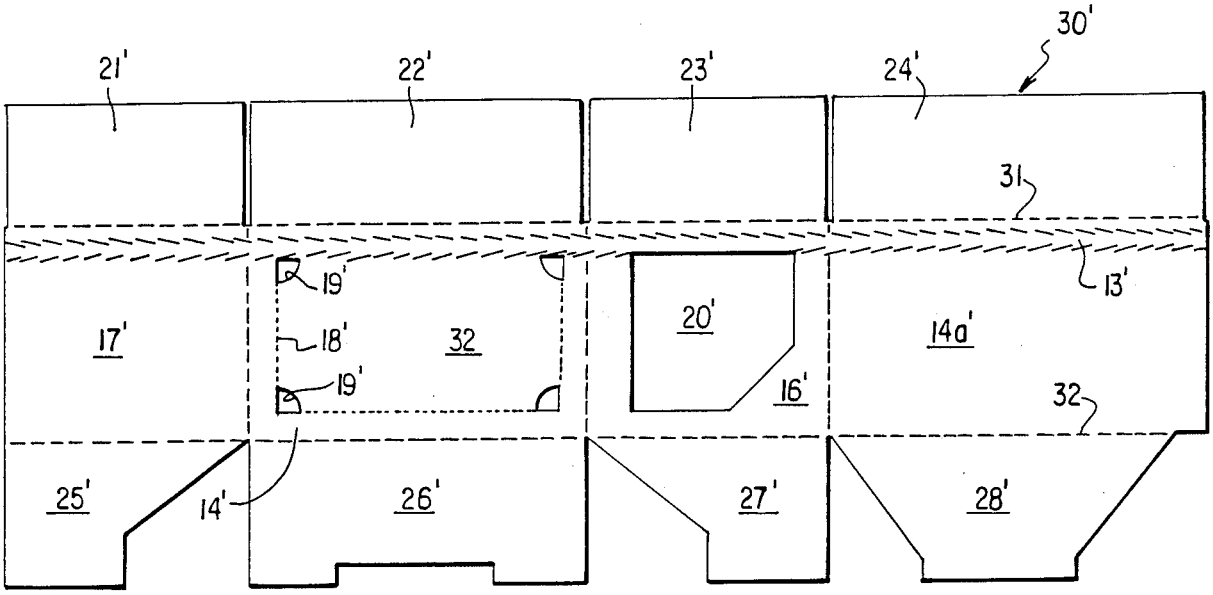
FIG. 3 is a top view of a flat cut-out blank for making a display carton in accordance with a further embodiment of the invention.

FIG. 3 shows a flat cut-out blank 30′ for forming a display carton in accordance with a further embodiment of the invention. In FIG. 3 the primed reference numbers correspond to the respective un-primed reference numbers of FIG. 2.

In FIG. 3, the flaps 21′, 22′, 23′, and 24′ are foldable along line 31 to form the cover of the display carton of the second embodiment, and flaps 25′, 26′, 27′, and 28′ are foldable along line 32 to form the bottom. Blank 30′ also includes a front wall 16′ having a removal opening 20′, a rear wall 17′, and side walls 14′ and 14*a*′. Reference number 13′ identifies a tear strip.

With continuing reference to FIG. 3, side wall 14′ is provided with perforated lines 18′ to permit easy removal of the major portion of side wall 14. In contrast to the first embodiment, however, side wall 14′ is provided with finger openings 19′ at all four corners. The purpose of this is to permit easy removal of the central portion 32 of side wall 14 even if tear strip 13′ has not yet been removed. disclosed in Federal Republic of Germany application G 87 08 423 of June 15th, 1987, the entire disclosure of which is incorporated herein by reference.

It will be understood that the above description of the present invention is susceptible to various modifications, changes, and adaptations, and the same are intended to be comprehended within the meaning and range of equivalents of the appended claims.

What we claim is:

1. A block-shaped display carton for individually packaged merchandise, comprising:

a bottom;

a front wall connected to the bottom, the front wall having a removal opening which extends upward from a position adjacent the bottom;

a rear wall connected to the bottom and spaced apart from the front wall;

a side wall between the front and rear walls, the side wall being connected to the front and rear walls and to the bottom, the side wall having a central portion and having perforation means adjacent the bottom and adjacent the front and rear walls for permitting the central portion of the side wall to be torn away;

a cover; and a peripheral tear strip in the walls adjacent the cover, the removal opening in the front wall extending up to the tear strip.

2. The display carton of claim 1, wherein the perforation means comprises a perforated line adjacent the bottom and perforated lines adjacent the front and rear walls, the perforated lines adjacent the front and rear walls extending up to the tear strip.

3. The display carton of claim 2, wherein the side wall has a finger opening communicating with a perforated line.

4. The display carton of claim 2, wherein the side wall has a finger opening between the perforated line adjacent the bottom and the perforated line adjacent the front wall, and a finger opening between the perforated line adjacent the bottom and the perforated line adjacent the rear wall.

5. The display carton of claim 4, wherein the perforated lines adjacent the front and rear walls have top ends, and wherein the side wall has finger openings at the top ends of the perforated lines adjacent the front and rear walls.

6. The display carton of claim 1, wherein the cover, bottom, and walls of the display carton comprise a unitary cut-out blank.

7. The display carton of claim 1, wherein each individual package of merchandise is elongated and has a first end and a second end, and wherein the display carton further comprises another side wall connected to the bottom and to the front and rear walls, the side wall and the another side wall being spaced apart, the first ends of the individual packages of merchandise being positioned adjacent the side wall and the second ends of the individual packages of merchandise being positioned adjacent the another side wall, and wherein the central portion of the side wall is dimensioned so that the first end of each individual package of merchandise is exposed when the central portion is torn away.

* * * * *